US005531197A

United States Patent [19]

Lobb

[11] Patent Number: 5,531,197

[45] Date of Patent: Jul. 2, 1996

[54] VARIABLE DISPLACEMENT ROTARY INTERNAL COMBUSTION ENGINE

[76] Inventor: David R. Lobb, 1 Chestnut St., Pomeroy, Pa. 19367

[21] Appl. No.: 544,053

[22] Filed: Oct. 17, 1995

Related U.S. Application Data

[63] Continuation-in-part of Ser. No. 327,752, Oct. 24, 1994, Pat. No. 5,494,014.

[51] Int. Cl.[6] ..... F02B 53/00

[52] U.S. Cl. ..... 123/243

[58] Field of Search ..... 123/231, 243, 123/247

[56] References Cited

U.S. PATENT DOCUMENTS

| | | | |
|---|---|---|---|
| 781,342 | 1/1905 | Hoffman . | |
| 1,113,234 | 10/1914 | Morgan | 123/231 |
| 1,116,781 | 11/1914 | Amey . | |
| 1,309,767 | 7/1919 | Morgan | 123/231 |
| 1,349,353 | 8/1920 | Wilber . | |
| 2,263,361 | 11/1941 | Lawrence | 123/247 |
| 3,908,608 | 9/1975 | Fox | 123/243 |
| 3,960,116 | 6/1976 | Ingham | 123/243 |
| 3,978,825 | 9/1976 | Rogers . | |
| 4,241,713 | 12/1980 | Crutchfield | 123/243 |
| 5,072,705 | 12/1991 | Overman | 123/231 |

FOREIGN PATENT DOCUMENTS

| | | | |
|---|---|---|---|
| 630868 | 12/1961 | Italy | 123/231 |
| 7712959 | 5/1979 | Netherlands | 123/243 |

OTHER PUBLICATIONS

Simon and Schuster, *The Way Things Work*, vol. 1, 1963, 1967, pp. 472–473.

*Primary Examiner*—Michael Koczo
*Attorney, Agent, or Firm*—Michael F. Petock

[57] ABSTRACT

A rotary internal combustion engine includes a block having a generally elliptically shaped bore and a substantially round rotor adapted to rotate on a straight shaft in the bore of the block. The rotor is provided with a pair of substantially diametrically mounted rotor segments, the rotor being provided with a pair of recesses for receiving the rotor segments and the rotor segments being pivotally mounted to the rotor such that a portion of each rotor segment tends to be forced outwardly by centrifugal force upon the rotation of the rotor. The block is provided with a charging and a combustion space formed in the space between the elliptical shaped bore and the round rotor. The combustion chamber is enlarged by the outward movement of an outer segment pivotally mounted on the block. A pair of vanes between the rotor segments are mounted in slots on the rotor for the forming of a seal between the rotor and the inner surface of the bore of the block. The engine may be operated on any type of gaseous fuel. The narrowing of the space between the round rotor and elliptically shaped bore functions to compress the air/fuel mixture enclosed between the vane and the rotor segment. The engine provides two combustions per revolution. Larger engines may be constructed coupling any number of rotors and blocks either in line or side by side with the rotors coupled together. A variable displacement engine is provided by varying the size of the combustion chamber by limiting the outward movement of the outer segment.

9 Claims, 6 Drawing Sheets

FIG. 4
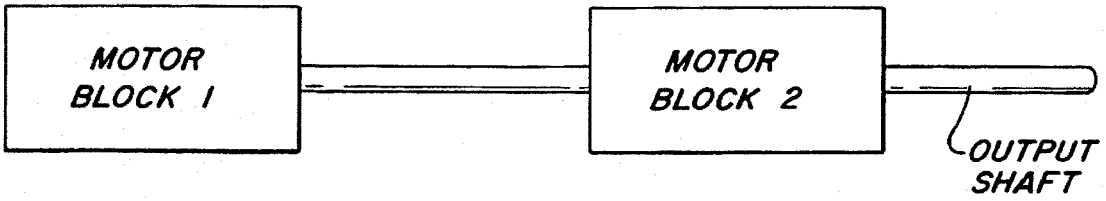
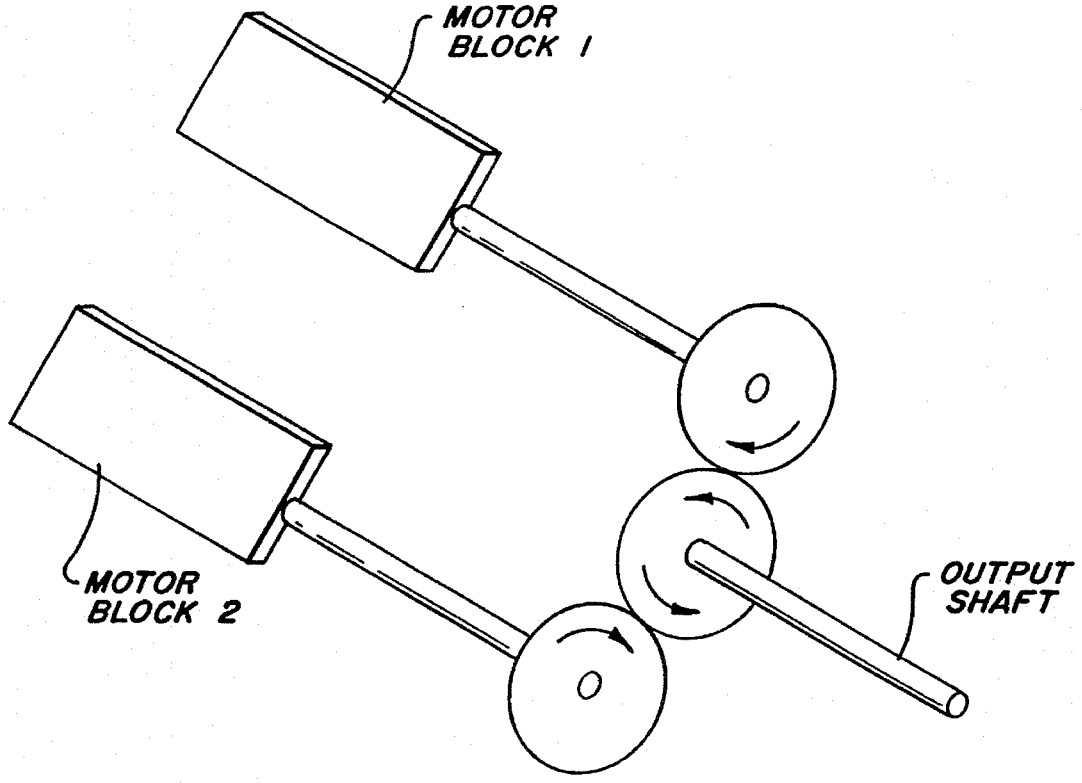
FIG. 5

FIG. 7
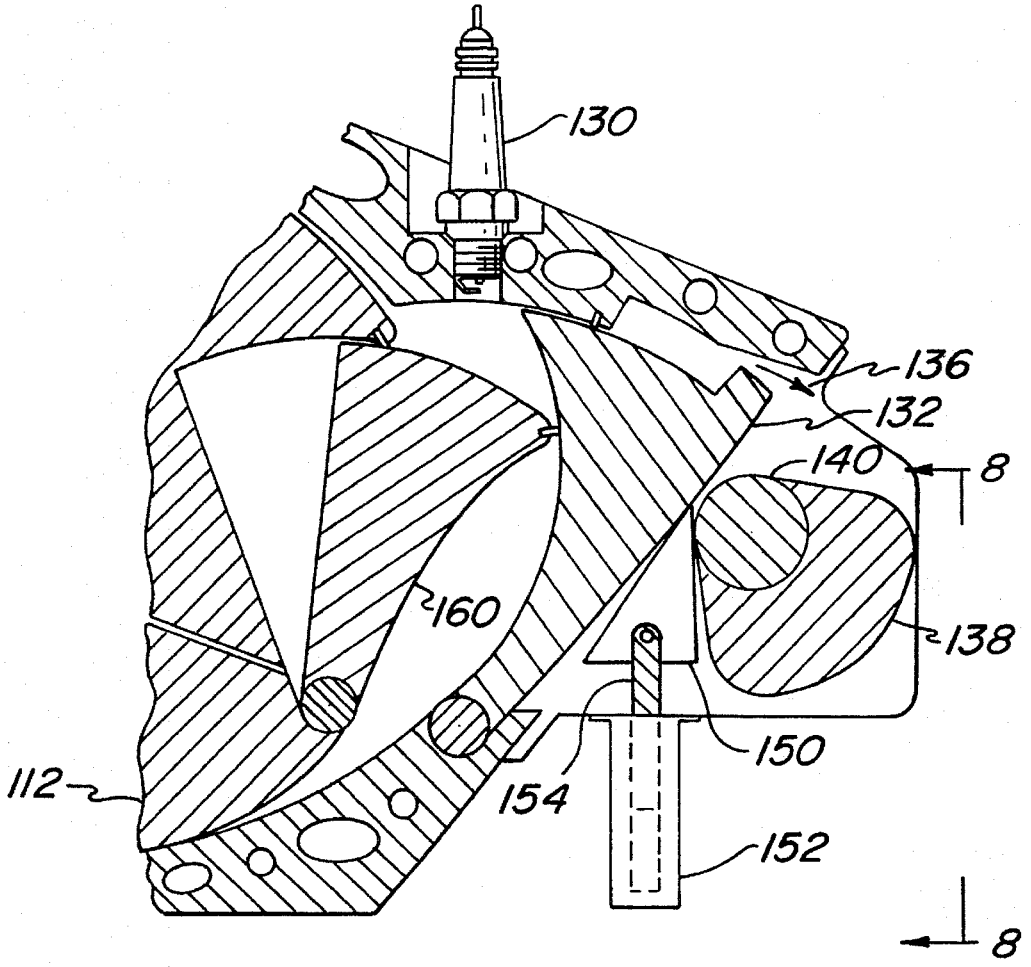
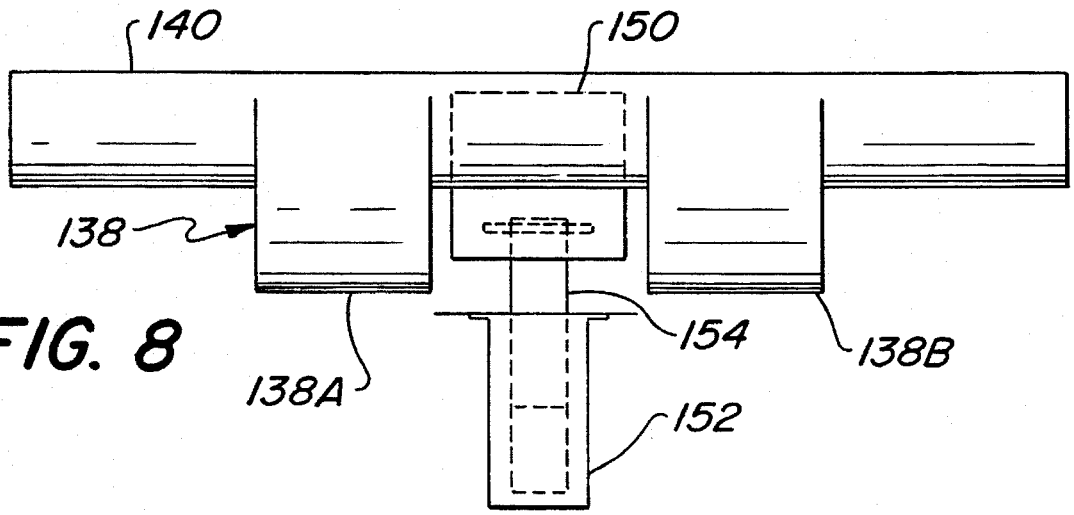
FIG. 8

VARIABLE DISPLACEMENT ROTARY INTERNAL COMBUSTION ENGINE

CROSS REFERENCE TO RELATED APPLICATION

This is a continuation-in-part application of application Ser. No. 08/327,752, filed Oct. 24, 1994, now U.S. Pat. No. 5,494,014, by the inventor herein and entitled "ROTARY INTERNAL COMBUSTION ENGINE". The benefits of the filing date of this earlier application, for so much as is common with this application, are hereby claimed.

FIELD OF THE INVENTION

The present invention relates to a rotary internal combustion engine. More particularly, the present invention relates to an improved rotary internal combustion engine having a number of advantages over the prior art.

BACKGROUND OF THE INVENTION

Much work has been done in the field of internal combustion engines of both the reciprocating and rotary types. The present invention is directed to an improvement on the rotary type internal combustion engine. In the past, efforts have been made in this area including those disclosed in U.S. Pat. No. 1,116,781-Amey; U.S. Pat. No. 1,349,353-Wilber, Jr.; U.S. Pat. No. 2,263,361-Lawrence, Jr.; and U.S. Pat. No. 3,978,828-Rogers.

SUMMARY OF THE INVENTION

The present invention provides a number of advantages including a rotor that revolves on a straight line shaft, i.e. the rotor does not rotate in an eccentric manner but revolves around a single axis.

Another advantage resides in the cooperating shape of the rotor and housing or block which provides with continuous shapes an increased area for charging, a compression area and an enlarged combustion area which is further controlled by an operative outer segment in the block. In a presently preferred embodiment, the rotor is provided with a substantially round shape and the bore in the block or housing is provided with a generally elliptical shape, providing increased spaces between the rotor and the block in the charging and combustion areas.

Another advantage of the present invention is the shape and manner of mounting of rotor segments on the rotor which function as force receiving or "piston" structures as well as functioning in the charging function (air and fuel intake).

Another advantage of the present invention is that it is readily adaptable to providing two firings or combustions per revolution, which may be referred to as one half cycle verses the common two or four cycle engines.

Another advantage of the present invention is its ability to operate on various combustible gases with little or no modification, including natural gas, gasoline, propane, diesel fuel, etc.

Another advantage of the present invention is its flexibility, wherein the present invention may be utilized to structure motors of various sizes and configurations, including any number of rotors with rotor sections laid out in line, side by side, over, under or any combination of these arrangements.

Another advantage of the present invention is its efficiency due to less friction than other current designs, its constant circular motion as opposed to reciprocating piston engines or known eccentric designs involving rotary engines, such as the "Wankel" engine.

Another advantage of the present invention is that it provides a rotary internal combustion engine with variable displacement.

Another advantage of the present invention is that it provides an internal combustion engine with variable displacement accomplished by varying the size of the combustion chamber.

Briefly and basically, in accordance with a preferred embodiment of the present invention, a rotary internal combustion engine is provided in the form of a block having a bore therein. A rotor is adapted to rotate in the bore in the block. The rotor and the block bore are shaped so that one is generally elliptically shaped and the other is generally round in cross section or cylindrical providing increased space between the rotor and the block in the charging and combustion areas. Means are provided on the block for forming a charge area, typically in the form of an air inlet and a fuel injector, and another area on the block is formed to function as a combustion area which would include an igniting or firing means in the form of a spark plug. A pair of rotor segments are mounted on the rotor, the rotor segments being adapted to recede into spaces formed in the rotor and to extend from the rotor in the charging and combustion areas such that one segment is being utilized in connection with the receiving of a charge at approximately the same time that the other is extended to function as a receiver of force in the combustion area to drive the rotor.

In a presently preferred embodiment, vanes are utilized to provide seals between the rotor and the block so as to divide the block into two rotor segment areas. Once a charge is received between the trailing end of one segment and the vane, it is compressed due to the decreasing space between the rotor and the block as the rotor rotates. As the rotor rotates further into the combustion area, the segment is caused to extend into the combustion chamber either as a result of centrifugal force alone or as a result of a centrifugal force with the assistance of a mechanical means such as a spring, while at the same time the combustion area is caused to be enlarged by the outward movement of an outer segment on the housing. The firing of an ignition means, such as a spark plug, causes a driving force on the rotor segment causing the rotor to rotate. The outer segment may be controlled by various means, but in a preferred embodiment, the outer segment is controlled by a cam shaft driven by the rotor. Subsequently, products of combustion are exhausted through an exhaust port.

The present invention provides a variable displacement internal combustion engine. Furthermore, the present invention provides a variable displacement internal combustion engine in which the variable displacement function is accomplished by means of varying the size of the combustion chamber. In a presently preferred embodiment, a controlled variable stop in the form of a limiting wedge and an actuator is used to control the outer limit of travel of the outer segment On the housing. The limiting wedge may be positioned between the cam shaft and the outer segment and operated by an actuator to limit the outward travel of the outer segment. With the limiting wedge fully retracted, the outer segment is allowed to move outwardly to the maximum extent creating full displacement. As the limiting wedge is extended by the actuator, the outward movement of the outer segment is reduced, thereby reducing the size of the combustion chamber and lowering the displacement of the engine.

The present invention is not limited to the preferred embodiment illustrated and described, but such specifics are provided for the purposes of illustrating a presently preferred embodiment.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

FIG. 4 is a block diagram illustrating a plurality of internal combustion engines connected together in series.

FIG. 5 is a block diagram of a plurality of internal combustion engine units in accordance with the present invention connected together in parallel or side by side relationships.

FIG. 7 is broken away cross sectional view of a portion of the embodiment shown in FIG. 6 with the travel of the outer segment limited to a different value to produce a different degree of displacement than that shown in FIG. 6.

FIG. 8 is an elevation view taken along line 8-8 of FIG. 7 of a wedge structure for limiting the travel of the outer segment mounted between a divided cam.

DETAILED DESCRIPTION OF THE PREFERRED EMBODIMENT

Figure 1:
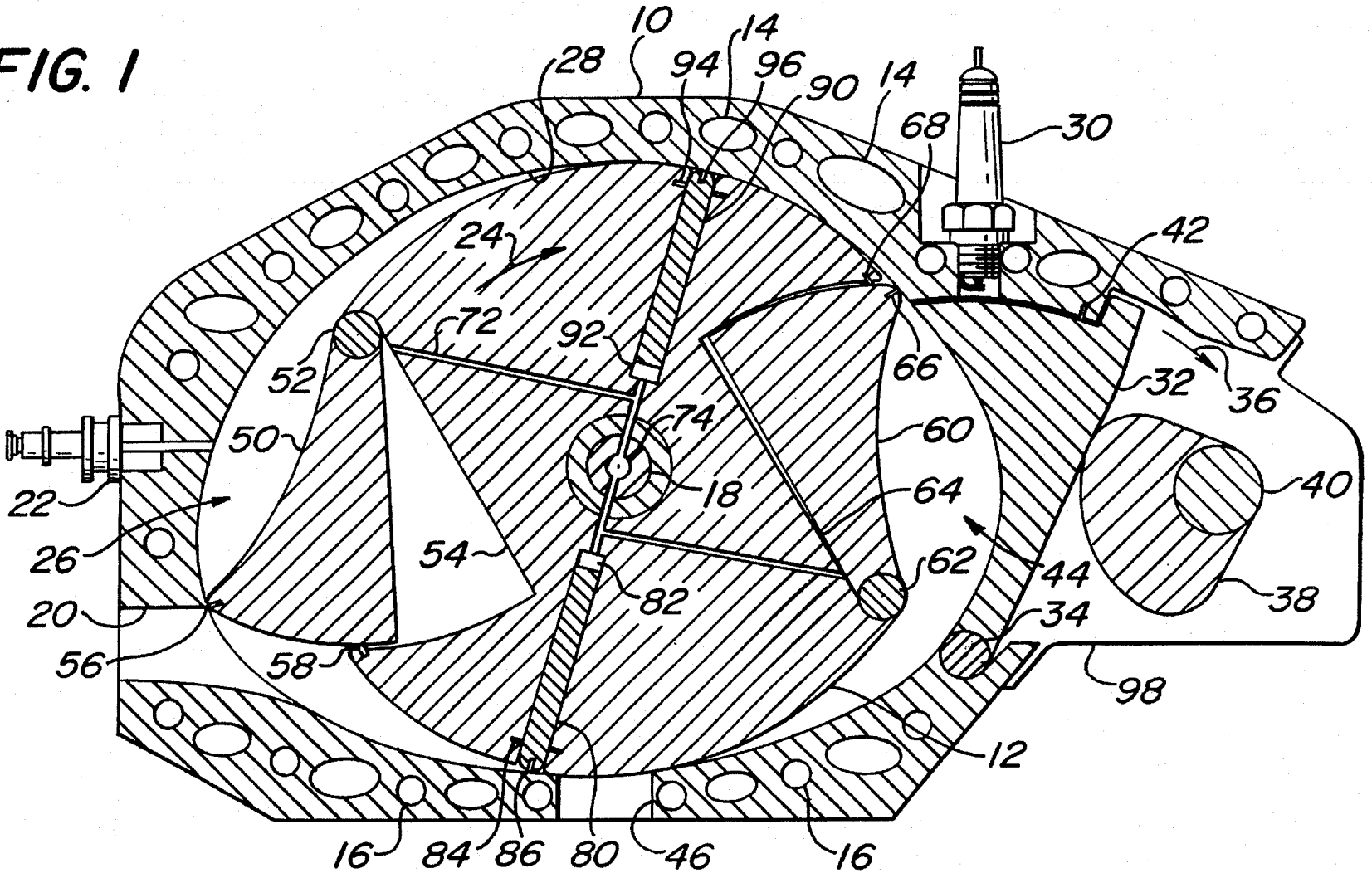
FIGS. 1, 2 and 3 are cross sectional views of a preferred embodiment of a rotary combustion engine in accordance with the present invention showing the rotor in three different positions.
Figure 2:
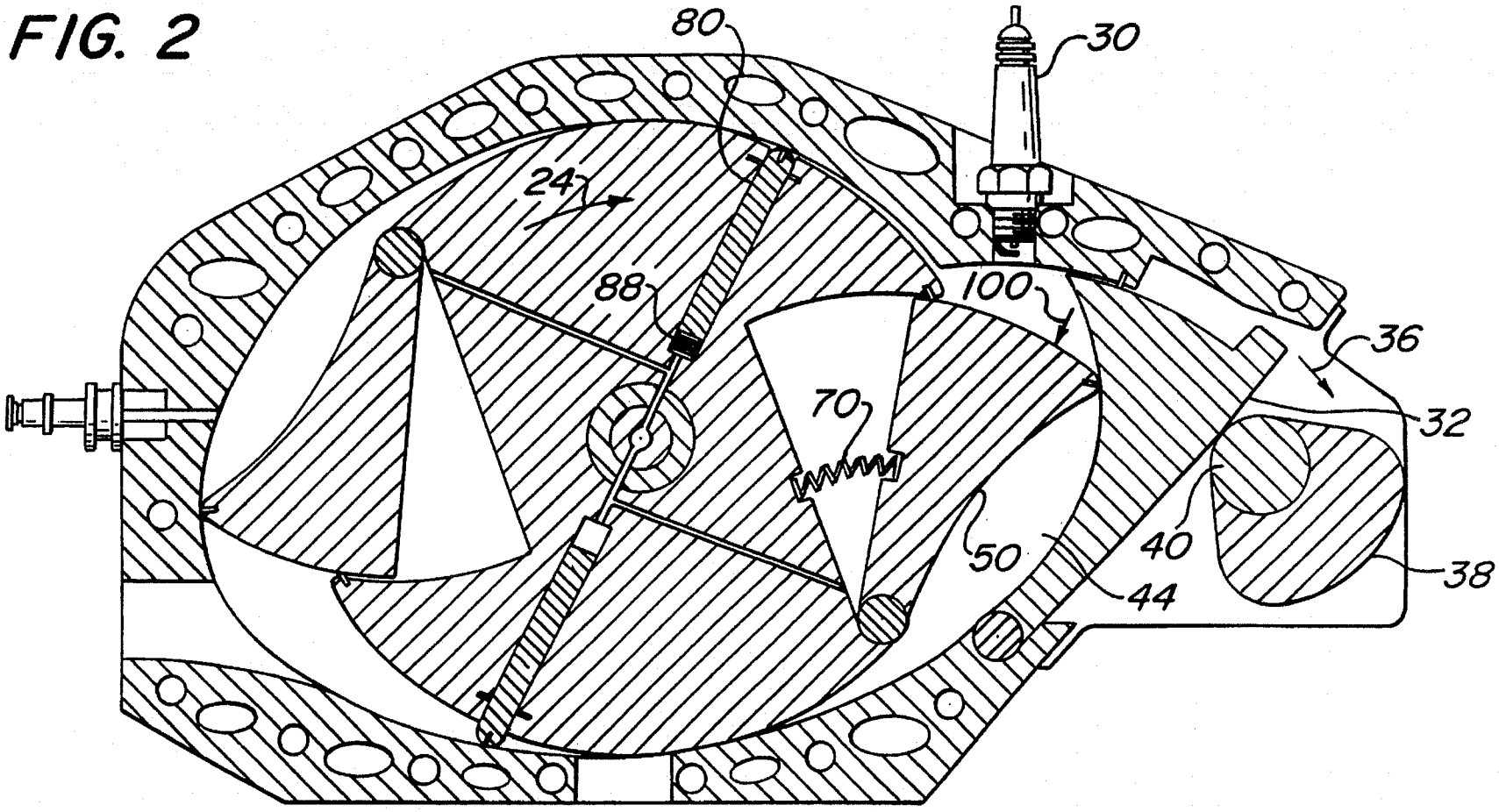
Figure 3:
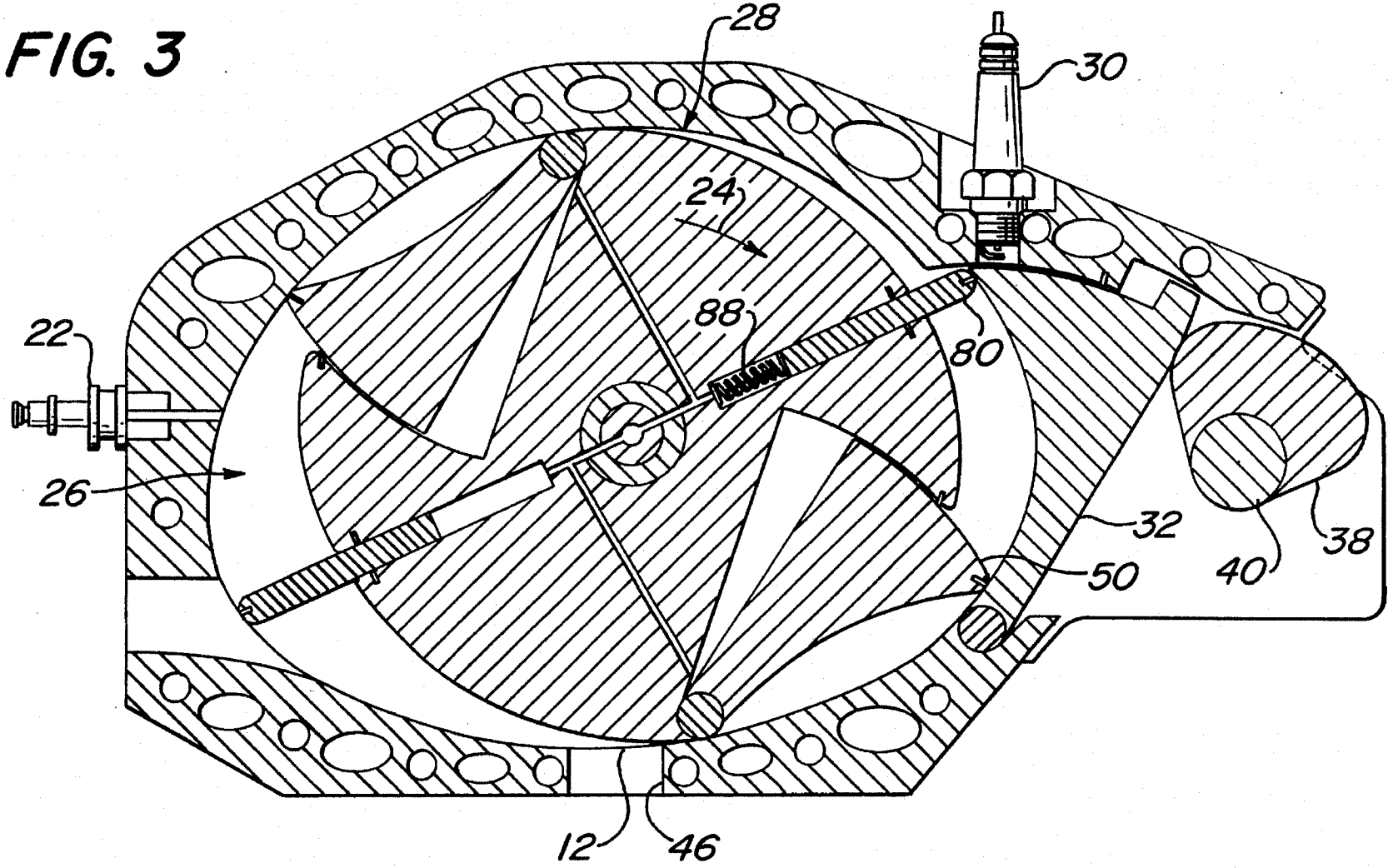

Referring now to the drawings, wherein like numerals indicate like elements, there is shown in FIGS. 1, 2 and 3, a block or housing 10 and a rotor. 12 of a presently preferred embodiment of the present invention. Block 10 is provided with a plurality of cooling ports 14 which may receive a cooling medium therethrough, such as air, water or other fluids. The cross sectional view in FIGS. 1 through 3 is the same embodiment with the rotor 12 shown in three different rotary positions which will help to illustrate the description of the operation of the engine. Block or housing 10 is provided with a plurality of fastening holes 16 which may be tapped or untapped depending upon the arrangement. FIGS. 1 through 3 illustrate a single rotor which might be considered to be analogous to a single cylinder in a one cylinder reciprocating engine. End plates are fastened by means of fasteners through at least some of the fastening holes 16 which may be tapped to form a closed unit. A plurality of such housings and rotors may be bolted or otherwise fastened together in line in series as illustrated in FIG. 4. Alternatively, a plurality of these engine units may be mounted together in side by side relationship (independent of orientation whether they are horizontally on side by side or at any various angle or vertically mounted, side by side merely referring to rotor shafts 18 being arranged in parallel as illustrated in FIG. 5. Such rotor shafts may be connected together by gearing, chain drives or other suitable coupling means.

In the preferred embodiment illustrated, block 10 is provided with an air intake port 20 and a fuel injector 22. However, it is understood that various modifications may be made in this area, including the use of one input port which would receive a mixture of air and fuel from a carburetor to form a charging area. The area between block 10 and rotor 12 in the area of air intake port 20 and fuel injector 22 may be referred to as a charging area, that is where the air and fuel to be subsequently combusted enter the engine.

Rotor 12 rotates in a clock wise direction as illustrated by arrow 24. The charging area may be generally identified by the numeral 26. However, it is understood that this is a broad area extending from below the air intake port 20 to beyond the fuel injector 22. As the rotor 12 continues to rotate in the direction of arrow 24, there is a continuous decrease in the space between the rotor 12 and the inner surface of the bore of block 10 and this broad area may be referred to as the area of compression 28. Again, it is understood that the compression area is a broad area extending from the charging area to the combustion area to be discussed hereinafter. As the rotor 12 rotates in the direction of arrow 24, the air/fuel mixture trapped between the trailing edge of rotor segment 50 and the leading edge of vane 80 is compressed as the volume between this portion of the rotor and the inner surface of the bore of block 10 becomes significantly smaller.

Block 10 is provided with a spark plug 30. It is understood that any suitable means for generating a spark is contemplated to be within the scope of the present invention and defined by the general term spark plug. Immediately below spark plug 30 is a moveable outer segment 32 which is pivotally mounted at 34 to block 10. Outer segment 32 is movable in the direction of arrow 36, which is illustrated in FIGS. 1 and 2. Outer segment 32 may be operated by various means, timed with the rotation of rotor 32 such that outer segment is moved in the direction of arrow 36 for the purpose of combustion at the time of the generation of a spark by spark plug 32. As illustrated in the drawings, a presently preferred method of operating outer segment 32 would be a cam 38 mounted on a cam shaft 40 which may preferably be driven by a coupling to rotor shaft 18. This coupling may be by any suitable means, including gearing, a chain drive or the like. However, it is understood that other suitable means of operating segment 32 may be utilized in practicing the present invention, such as a solenoid type device operated in response to a sensor responsive to indicia corresponding to the position of rotation of shaft 18. Outer segment 32 may be provided with a suitable seal such as seal 42. Of course various other arrangements may be utilized in providing the sealing function, including the seal being mounted within segment 32 as contrasted to it being mounted within block 10 as shown. The combustion area may be generally identified by the numeral 44 for the purposes of ease of discussion. Combustion area 44 generally extends from under spark plug 30 down to the area approaching exhaust port 46 which is provided in block 10 for the removal of the products of combustion. Outer segment 32 moves in the direction of arrow 36, thereby allowing a rotor segment, at the appropriate time, such as rotor segment 50 shown in FIG. 2, to move outwardly with the air/fuel mixture being between the trailing edge of rotor segment 50 and the tip of spark plug 30. Upon firing of spark plug 30, the force of the combustion or explosion drives rotor segment 50 in the direction of arrow 100 causing further rotation of rotor 12 in the direction of arrow 24.

Referring now to rotor 12 in greater detail, rotor 12 is provided with rotor segments 50 and 60 which are pivotally mounted to rotor 12 by suitable pivot structures such as pins 52 and 62, respectively. Rotor 12 is provided with recesses 54 and 64 which are formed in rotor 12 so that they may receive rotor segments 50 and 60, respectively. Although in the presently preferred embodiment, recesses 54 and 64 are machined or otherwise formed in rotor 12 so that rotor segments 50 and 60 may be received fully therein, it is understood that these recesses may be less if greater space were provided between the rotor and the block bore surface in the compression and exhaust areas. However, in the presently preferred embodiment as illustrated, recesses 54 and 64 would be formed so that rotor segments 50 and 60 may be fully retracted into the rotor. Rotor segments 50 and 60 are provided with seals 56 and 66, respectively, to form a tight seal between the outer most portion of the rotor segments and the interior surface of the bore in block 10. Additionally, seals 58 and 68 may be provided between the rotor segments and the rotor to keep recesses 54 and 64, respectively, clean or clear of any debris, such as carbon deposits from combustion.

Rotor segments 50 and 60 may be operated or extended from recesses 54 and 64, respectively, solely as a result of centrifugal force, particularly at higher operating speeds of rotor 12. Alternatively, as illustrated, spring 70 may be provided between the rotor segments and the back wall of the rotor recess. Lubrication passageways 72 may be drilled or otherwise formed in rotor 12 to provide suitable lubrication to points as needed. This may be fed from an oil passageway 74 in rotor shaft 18. Such lubrication may be provided to pivot points of the segments, to the vanes and as otherwise deemed desirable.

Rotor 12 is provided with vanes 80 and 90 to provide separation between the operation of rotor segments 50 and 60. In other words, as may be seen in FIG. 1, intake air may be trapped between the trailing edge of rotor segment 50 and vane 80. Vanes 80 and 90 are mounted in slots or recesses 82 and 92, respectively, formed in rotor 12. Vanes 80 and 90 are provided with seals 84 and 94, respectively, between the vanes and their rotor recesses. The outer most portion of vanes 80 and 90, that is the portion which is juxtaposed the inner surface of the bore of block 10, are provided with seals 86 and 96, respectively, to form a seal between the vanes and the inner surface of the bore block 10. As with the rotor segments, vanes 80 and 90 may be operated by centrifugal force to maintain a seal between the vanes and the block bore, particularly at higher speeds of rotation of rotor 12, but alternatively, the vanes may be provided with springs 88 to assist in this function. As illustrated, the cam shaft drive for outer segment 32 may be provided with a cover 98 to enclose this operating structure and retain lubrication.

In operation, referring to FIG. 1, as the rotor rotates, centrifugal force moves the vanes and rotor segments into contact with the block bore. As rotor segment 50 passes air intake 20, air is drawn into the portion of charging area 26 between the following end of rotor segment 50 and vane 80. When the rotor segment passes fuel injector 22, fuel is injected into the air as may be best seen from FIG. 3 where vane 80 is in the process of traversing air intake port 20 in charging area 26. As vane 80 passes air intake 20, the air/fuel mixture is trapped between vane 80 and the trailing edge of rotor segment 50 and seal 56. This air fuel mixture, as the rotor 12 continues to rotate in the direction of arrow 24, is forced into a decreasing volume in compression area 28 and is compressed.

As rotor 12 continues to rotate in the direction of arrow 24, rotor segment 50 enters the combustion area 44 with outer segment 32 having been allowed to move in the direction of arrow 36 as a result of the rotation of cam 38 and cam shaft 40. Spark plug 30 having been fired, the resulting combustion causes the heated expanding gas of combustion to force rotor segment 50 in the direction of arrow 100. In other words, when the rotor segment 50 reaches the outer segment 32, the cam shaft 40 rotates cam 38 to its low point thereby allowing outer segment 32 to swing in the direction of arrow 36. The rotor segment 50 follows the outer segment outward thus forming a combustion area under the spark plug. At this point, the compressed air/fuel mixture is forced into the combustion area and is ignited by the spark plug. The resulting explosion forces the rotor segment in the direction of arrow 100 away from the combustion area creating power.

As may be better seen in connection with FIG. 3, as the rotor 12 continues to rotate in the direction of arrow 24 during the power stroke, the cam shaft starts to push the outer segment 32 back in a direction opposite to the direction of arrow 36. When the outer segment is all the way back, the burned gases are trapped between the rotor segment 50 and the following vane 80. The burned gases are forced into a decreasing area as the rotor segment passes the exhaust port and the products of combustion are forced out of exhaust port 46 by vane 80.

The process is repeated for the second rotor segment 60/vane 90 combination. This process occurs twice per revolution, once for each rotor segment/vane combination.

Figure 6:
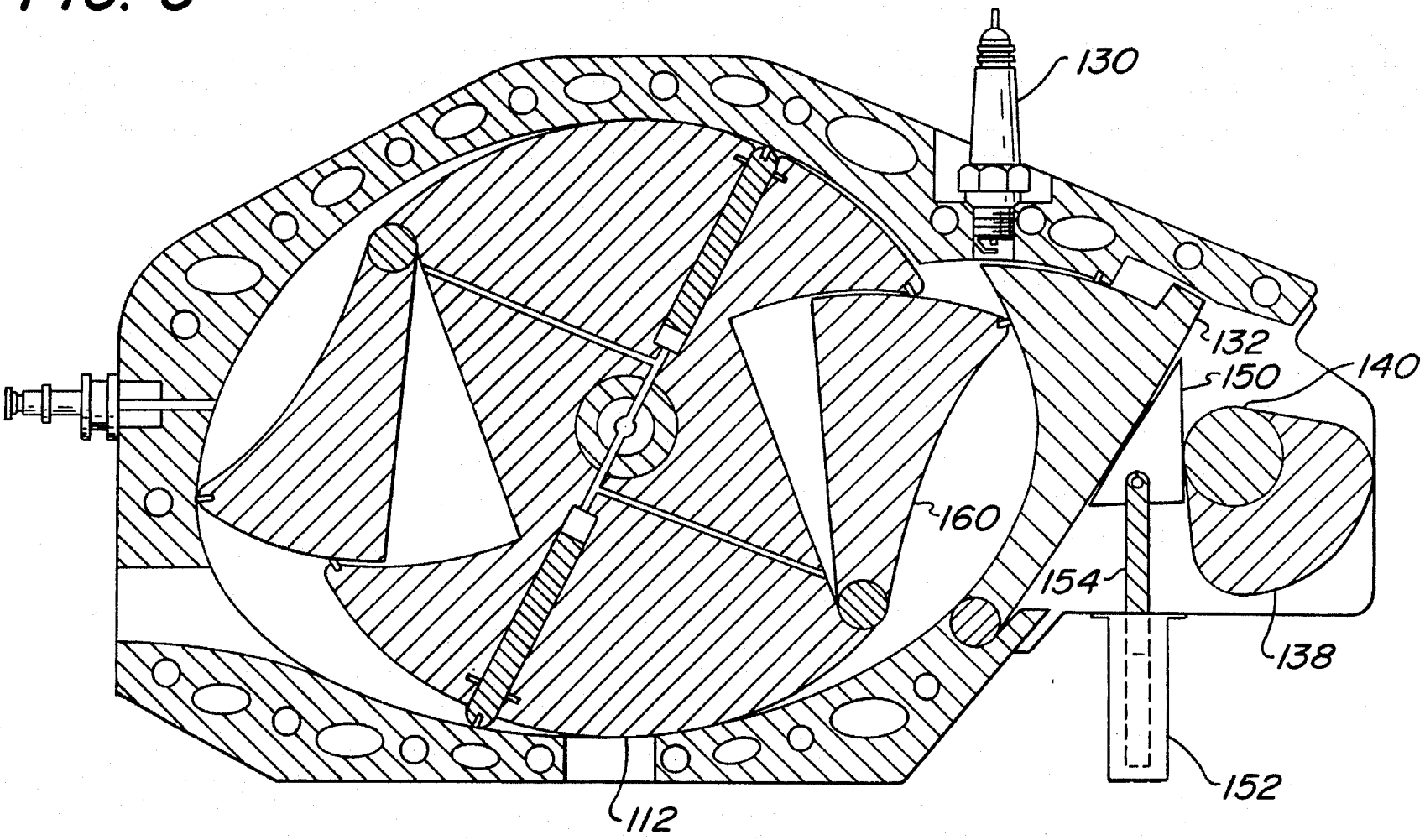
FIG. 6 is a cross sectional view of a preferred embodiment of a variable displacement rotary combustion engine in accordance with the present invention.

Referring now to FIG. 6, 7 and 8, there is shown a rotary internal combustion engine with variable displacement achieved through varying the size of the combustion chamber. Means are provided for limiting the range of movement of the outer segment independent of the cam shaft. This may be accomplished by adjustable stops of various structure which would limit the outward movement of the outer segment. There is illustrated in FIGS. 6, 7 and 8 a presently preferred embodiment of the invention wherein the range of motion or range of outward movement of outer segment 132 is limited by the position of a wedge shaped stop 150. The position of wedge shaped stop 150 is controlled by an actuator 152 which may be any suitable type of drive for wedge 150 including an electrical, mechanical or hydraulic drive. In a presently preferred embodiment, actuator 152 may be an electrical stepper motor which is connected to wedge shaped stop 150 by a threaded actuator link 154. The stepper motor may be controlled by various suitable electrical signals including the output of a mini-computer for controlling the amount of variable displacement.

The positioning of wedge shaped stop 150 as shown in FIG. 6 would provide an engine at approximately 25 percent displacement. A displacement of approximately 75 percent is shown in FIG. 7 by the positioning of wedge shaped stop 150. Other than the limiting of the outward movement of outer segment 132 by the adjustable stop or wedge 150, the rotary internal combustion engines shown on FIGS. 6 and 7 operate as described previously with respect to FIGS. 1 through 3.

FIG. 8 is a side elevation view of wedge 150 mounted between a divided cam shaft 138, illustrated in FIG. 8 as **138*a* and 138*b*. However, it is understood that other structures may be utilized to controllably limit the extreme of outward movement of outer segment 132** other than that illustrated herein.

In the fixed displacement embodiment shown in FIGS. 1, 2 and 3, the movement of outer segment 32 follows cam 38. However, in the variable displacement embodiment illustrated in FIGS. 6, 7 and 8, the movement of segment 132 follows cam 138 only so long as adjustable wedge shaped stop 150 is fully retracted, that is, at its lower most position towards actuator body 152 wherein outer segment 132 is allowed to follow the shape of cam 138 as it rotates. As the adjustable wedge shaped stop 150 is extended or raised, outer segment 132 in the variable displacement embodiments illustrated in FIG. 6, 7 and 8 follows cam 138 in the normal manner for a portion of the rotation, but depending upon the positioning of stop 150, the outermost movement of outer segment 132 in the direction of arrow 136 is limited by wedge shaped stop 150. In other words, for a portion of the cycle of cam 138, outer segment 132 is precluded from following the cam by wedge shaped stop 150. The positioning of wedge shaped stop 150 is infinitely variable by actuator 152 in response to a minicomputer or other suitable control signal, and FIG. 6 illustrates a 25 percent displacement where wedge shaped stop 150 has been extended to a considerable degree and FIG. 7 illustrates a 75 percent displacement where wedge shaped stop 150 has been extended to a lesser degree.

It is understood that various other arrangements may be utilized to provide a stop for outer segment 132 which is variable in response to a suitable control signal. Further, other structural arrangements may be made including the providing of a bushing on cam shaft 140 where wedge shaped stop 150 would be in contact with it.

The rotary internal combustion engine of the present invention may be operated on any combustible gaseous fuel including gasoline, diesel fuel, natural gas, propane, etc. The rotary internal combustion engine of the present invention is able to do this because of variances in the intake, compression and combustion areas. This may be accomplished by utilizing the same design by changing the fuel injector and air intake pressure to change the fuel/air ratio which will vary the amount of compression. Alternatively, changes may be made in the shape of the intake, compression and combustion areas such as by changing the shape of the bore in the block to provide the optimum volume areas for the different functions.

The, present invention may be embodied in other specific forms without departing from the spirit or essential attributes thereof and, accordingly, reference should be made to the appended claims, rather than to the foregoing specification as indicating the scope of the invention.

I claim:

1. A rotary internal combustion engine comprising:

a rotor provided with at least one outwardly moveable rotor segment;

a block having a bore within which said rotor rotates;

said block being provided with an outer segment pivotally mounted on said block, a combustion space being formed or enlarged by the outward movement of said outer segment; and means for controlling the outward movement of said outer segment, said means controlling the movement of said outer segment for each combustion cycle and being adjustable to control the range of movement to vary the maximum size of the combustion chamber to create a variable displacement engine.

2. A rotary internal combustion engine in accordance with claim 1 wherein said means for controlling the movement of said outer segment includes a cam on a cam shaft and means for limiting the outward movement of the outer segment independent of the cam.

3. A rotary internal combustion engine in accordance with claim 2 wherein said means for limiting the outward movement of the outer segment independent of the cam includes an adjustable stop.

4. A rotary internal combustion engine in accordance with claim 3 wherein said adjustable stop is a limiting wedge positioned by an actuator.

5. A rotary internal combustion engine, comprising:

a block having a bore therein;

a rotor adapted to rotate in said bore in said block;

said rotor and block bore being shaped so that one is generally elliptically shaped and the other is generally cylindrical;

means on said block for forming a charging area;

means on said block for forming a combustion area, said combustion area means including a moveable outer segment, said outer segment in the combustion area being movable away from said rotor thereby forming a combustion chamber just prior to the time of combustion; and a pair of rotor segments mounted on said rotor, one being adapted to be utilized to receive a charge at approximately the same time as the other is extended to function as a receiver of force in the combustion area to drive said rotor; and means for selectively controlling the outer limit of movement of said outer segment away from said rotor to selectively control the maximum size of said combustion chamber.

6. A rotary internal combustion engine in accordance with claim 5 wherein said rotor is substantially cylindrical and said block bore is generally elliptically shaped.

7. A rotary internal combustion engine, in accordance with claim 6 including a pair of vanes mounted in said rotor between said rotor segments for causing a seal between said rotor and said block bore.

8. A rotary internal combustion engine in accordance with claim 5 wherein said outer segment is operated by a cam on a camshaft.

9. A rotary internal combustion engine in accordance with claim 8 wherein said means for selectively controlling the outer limit of movement of said outer segment is an adjustable stop structured to limit the movement of the outer segment independent of said cam.

* * * * *

UNITED STATES PATENT AND TRADEMARK OFFICE

CERTIFICATE OF CORRECTION

PATENT NO. : 5,531,197
DATED : July 2, 1996
INVENTOR(S) : David R. Lobb

It is certified that error appears in the above-indentified patent and that said Letters Patent is hereby corrected as shown below:

Column 2, line 61, delete "On", insert --on--.

Column 3, line 43, delete "rotor.12", insert --rotor 12--.

Signed and Sealed this

Tenth Day of September, 1996

Bruce Lehman

*Attest:*

BRUCE LEHMAN

*Attesting Officer*

*Commissioner of Patents and Trademarks*